US005870481A

United States Patent [19]

Dymond et al.

[11] Patent Number: 5,870,481

[45] Date of Patent: Feb. 9, 1999

[54] METHOD AND APPARATUS FOR LOCALIZATION ENHANCEMENT IN HEARING AIDS

[75] Inventors: Robin Norman Dymond; Abram Gamer, both of Calgary, Canada

[73] Assignee: QSound Labs, Inc., Calgary, Canada

[21] Appl. No.: 718,920

[22] Filed: Sep. 25, 1996

[51] Int. Cl.[6] ..... H04R 29/00

[52] U.S. Cl. ..... 381/60; 381/313; 381/17; 381/310; 600/559

[58] Field of Search ..... 381/68.1, 26, 17, 381/60; 600/559

[56] References Cited

U.S. PATENT DOCUMENTS 5,325,436 6/1994 Soli et al. ..... 381/26

*Primary Examiner*—Forester W. Isen

*Attorney, Agent, or Firm*—Fulbright & Jaworski L.L.P.

[57] ABSTRACT

A method and apparatus to enhance or improve the sound localization properties of hearing aids determines the interaural level differences required for localizing sounds to a specific point of origin. These determined interaural level differences are then used in the adjusting and fitting of the hearing aids. A number of hearing tests at different frequencies with a sound source that apparently moves relative to the test subject are performed, and by adjusting the response of the hearing aid in the left ear relative to the right ear, for example by attenuating the left ear, the amount of attenuation or gain can be found that causes the test subject to perceive that the sound source is located at a specific point of origin. These determined interaural level differences are then used to design a new hearing aid or to modify the existing hearing aid.

32 Claims, 2 Drawing Sheets

4
DIFFERENTIAL
AMPLITUDE
L – R (dB)
FREQ (Hz)
10
AMPLITUDE
(dB)
FREQ (Hz)
LEFT
AMPLITUDE
(dB)
FREQ (Hz)
RIGHT
8
+
AMPLITUDE
(dB)
FREQ (Hz)
LEFT
AMPLITUDE
(dB)
FREQ (Hz)
RIGHT
6

22
A
20
0°
24
B
12
14
16
TO THE
COMPUTER
PP
18

METHOD AND APPARATUS FOR LOCALIZATION ENHANCEMENT IN HEARING AIDS

BACKGROUND OF THE INVENTION

1. Field of the Invention

This invention relates generally to a method and apparatus for use in improving hearing aids and, more particularly, to a method and apparatus for improving the ability of the wearer of hearing aids to achieve better sound localization.

2. Description of the Background

In view of the advances in semiconductor technology and the corresponding decrease in size, but increase in performance, of hearing aids, such hearing aids are becoming more and more commonplace. While advances have been made concerning the tailoring of the hearing aid response to the hearing deficiencies of the wearer, there remains a problem that the origin of sounds being amplified is difficult for the user to determine. That is, the user or listener's ability to localize sound is impaired by the actual functioning of bilateral hearing aids.

Although much research has gone into determining the manner in which the ears and the brain cooperate to permit a listener to determine the origin of a sound being heard, all of the factors permitting such sound localization have not been completely determined. One thing is known, however, that upon placing a hearing aid in the ear, the listener's ability to localize sound is impaired. Of course, an underlying requisite for a modern hearing aid is placing the hearing aid device within the ear of the user, thereby rendering the hearing aid more cosmetically acceptable. Therefore, a problem exists that most hearing aid wearers have their sound source localization ability impaired to some extent.

In regard to hearing aids in general, the current practice to fit a hearing aid by measuring each ear individually and then determining the compensation for that ear based solely on that ear's measurement. This approach provides hearing loss compensation but does not improve the wearer's sound localization ability.

OBJECTS AND SUMMARY OF THE INVENTION

Accordingly, it is an object of the present invention to provide a method and apparatus that can improve the ability of a hearing aid wearer to localize sounds and that can eliminate the above-noted defects present in the previously proposed systems.

Another object of the present invention is to provide a method and apparatus for determining the optimum differential gain setting for a hearing aid that maintains the person's normal sound localization ability.

According to an aspect of the present invention, an interaural level difference is determined as a function of frequency that produces a center sound image to a person fitted with bilateral hearing aids. Such bilateral hearing aids employ hearing loss compensation filters, and these filters are further modified based upon the determination of the interaural level difference data.

A number of frequencies are used in determining the localization cues, with such frequencies being generally in the upper frequency range because hearing aids provide more amplification in the high-frequency region. The measurements are taken at a level known as the most comfortable level, which is determined in a sequence of testing steps. In the test apparatus, a small-scale, portable digital signal processor is employed that has a highly controllable transfer function, with such processor then constituting the electronic portions for a left-ear hearing aid and a right-ear hearing aid, and with the respective filter coefficients being selectable by a computer.

In the procedure for determining the interaural level difference, a loudspeaker is placed behind a screen, with gradations marked on the front of the screen to the left and right sides of the center where the loudspeaker is actually located. The location of the loudspeaker is hidden from the test subject, but the test subject is informed that the sound source will move behind the screen along the indicated axis. By using the small portable processor and controlling the filter coefficients that are associated with the left and right hearing aids, it is possible for the operator to cause the apparent location of the sound to shift in the left and right directions relative to the center of the screen facing the test subject. Thus, it will seem to the test subject that the sound source, which is actually fixed behind the screen, is moving leftwardly or rightwardly based upon the controlled levels of the sounds in the left and right ears of the test subject. The patient then signals or makes notations concerning the apparent location of the sound source in response to successive changes in the filter coefficients, so that the interaural level difference data can be compiled and used to improve the sound localization performance of the bilateral hearing aid.

According to another embodiment of the present invention, the loudspeaker is placed in front of the patient without any screen marked with gradations and with no attempt to hide the loudspeaker location. The test subject is instructed to indicate the origin of the sounds hear based on adjustments made to the left and right hearing aids and to ignore the loudspeaker's location. The interaural level difference data generated is then used to design new bilateral hearing aids.

The above and other objects, features, and advantages of the present invention will become apparent from the following detailed description of illustrative embodiments to be read in conjunction with the accompanying drawings.

DETAILED DESCRIPTION OF PREFERRED EMBODIMENTS

Figure 1:
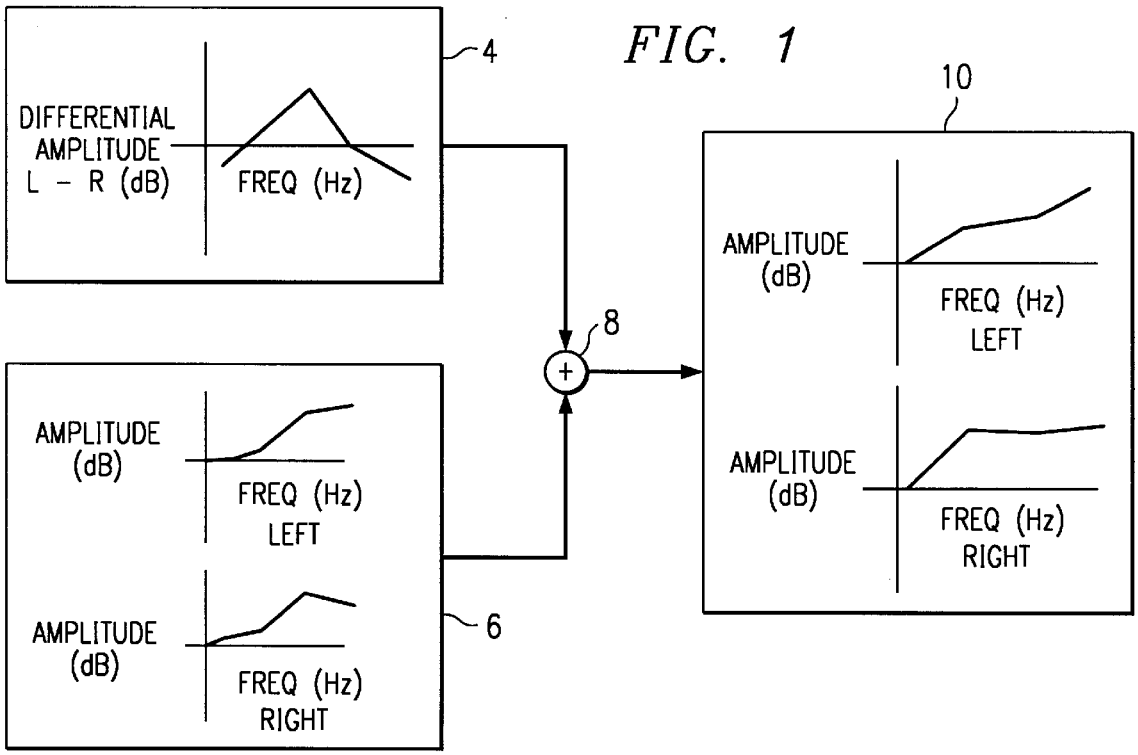
FIG. 1 is representation of the results obtained by use of the present invention.

FIG. 1 represents the results obtained in practicing the present invention. The response curve in block 4 represents an amplitude differential between the left and right ears plotted against audible frequencies. This amplitude differential is referred to as the interaural level difference and is obtained by use of the procedures and set-up that will be described in detail hereinafter. On the other hand, block 6 represents the respective responses for the left and right ears of a bilateral hearing aid. These bilateral hearing aid responses are obtained using standard hearing aid fitting methods. The interaural level difference data represented in block 4 is then combined with the bilateral hearing aid responses represented in block 6, and such combining operation is schematically represented by adder 8. While signal adding is a convenient way to explain such combination of the response curves, actually the hearing aid filter responses are modified based on the patient derived interaural level difference data represented in block 4. The results of such combination or modification are represented in block 10, which shows the left and right response curves for the bilateral hearing aids after the interaural level difference data has been included.

The embodiment of the present invention being described here presents to a patient or test subject wearing bilateral hearing aids the situation in which a sound source appears to be movably positioned at various different locations in the sound field. This apparent movement or relocation of the sound source is actually accomplished by controlling the response or transfer function of each of the left hearing aid and the right hearing aid.

Figure 2:
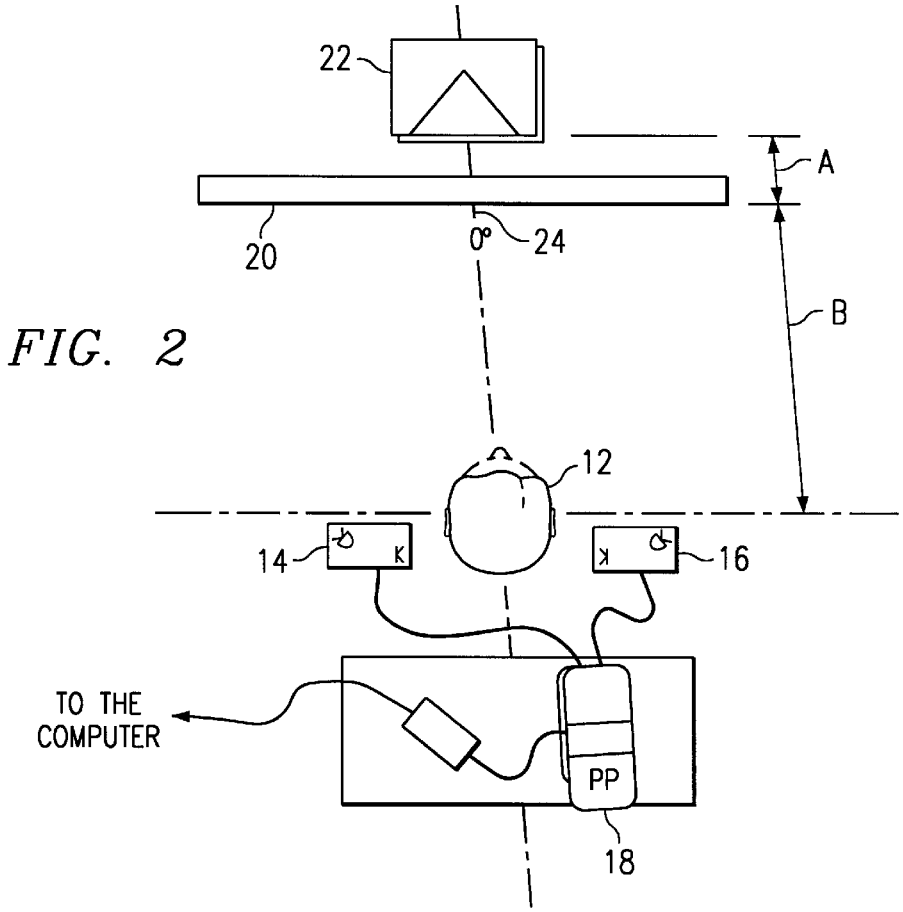
FIG. 2 is a pictorial representation of a test set-up useful in obtaining interaural level difference data according to an embodiment of the present invention.

In FIG. 2, a patient represented at 12 is provided with a left hearing aid 14 and a right hearing aid 16. The hearing aids 14, 16 as shown, in fact, are only the amplifier and transducer portion including the microphone and speaker, whereas the filter portion typically present in each hearing aid is provided by a so-called portable processor 18. It should be understood that the filter portion is what provides the different, frequency dependent response necessary to correct the measured hearing loss of the hearing aid wearer. The portable processor 18 performs as such filter in this test set-up, and is a dual channel signal processor that can provide any transfer function whatsoever over the audio range under control of a computer, such as a personal computer, not shown in FIG. 2. The computer is simply programmed to produce various filter coefficients over the hearing spectrum in response to inputs from a manual keyboard, not shown in FIG. 2. The patient 12 is arranged in front of a screen 20 that has a loudspeaker 22 arranged behind it so as to be out of sight to the patient 12. The screen has positive and negative gradations relative to the left and right directions from the zero center line 24, so that the patient can signal to the hearing professional conducting the test the apparent location of the sound source in terms of these gradations. The speaker is at a fixed distance A, around six to eight inches, behind the screen 20 to prevent dispersion of the sound and, similarly, the patient 12 is situated at a distance B, around two to three feet, in front of the screen 20 to eliminate any directional effects caused by the sound being reflected from the walls and the like of the test room.

Although in this embodiment the screen visually obscures the loudspeaker, such hiding from view need not be a part of the present invention. The apparent sound location changes because of the changes made by the filter at the ear, the screen simply helps the subject recognize this change by removing a conflicting visual cue, that is, the speaker does not move. The present method can be practiced without a screen, provided the patient is instructed to ignore the speaker and to indicate to the person conducting the test the apparent sound source location in relation to some reference point that can be visible, or that can simply be a location, such as "to the right" of the loudspeaker.

Figure 3:
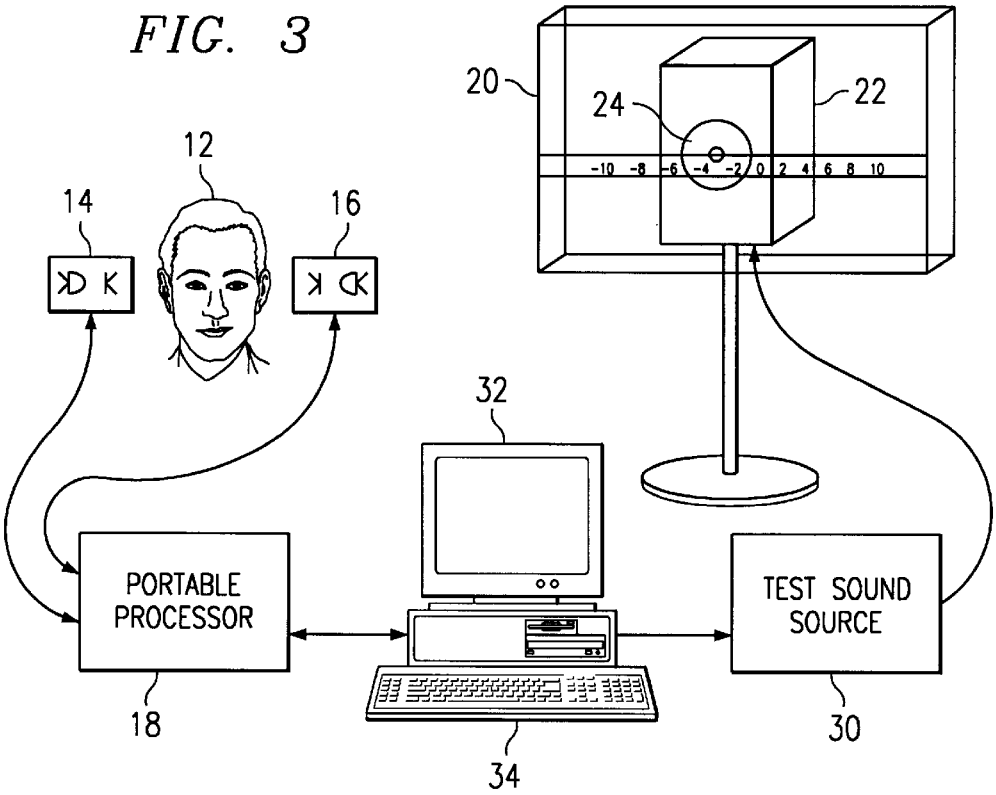
FIG. 3 is a perspective view of the embodiment of FIG. 2 shown in more detail.

Referring to FIG. 3, the same setup as shown in FIG. 2 is shown from a different viewpoint, that is, the screen 20 can be seen to obscure completely the location of the loudspeaker 22, so that the test subject 12 can not know that the speaker location is fixed. The various gradations along the left and right directions relative to the zero mark or center line 24 are shown in FIG. 3. These gradations can be from zero to plus or minus 6 or 8.

The loudspeaker 22 is provided with test tones at various frequencies by a tone source or noise generator 30 that is controlled by the system computer 32 in response to inputs from a keyboard 34. The audio source 30 generates a narrow band noise signal or tone centered at each of four or more selected test frequencies. By way of example only, such frequencies might be 2.5 kHz, 3.15 kHz, 4.0 kHz, and 5.0 kHz, keeping in mind that other frequencies might be chosen as well. Moreover, these test tones need not be narrow band tones but could also have wide band frequency content.

The so-called portable processor 18, which is actually functioning as the filter or response shaping portions of the bilateral hearing aids 14, 16, is controlled by the computer 32 to adjust the relative signal levels between the left and right hearing aids 14 and 16, respectively, so that the apparent location of the loudspeaker 22, as perceived by the patient 12, is moved leftwards or rightwards relative to the center line 24. It has been found that, in fact, reversing the apparent sound location between the left and the right should be done at least four times during the test in order to develop valid interaural localization difference data.

The apparent sound source location shift is accomplished by lowering the signal level in one ear relative to the other. This embodiment uses a 4 dB step size, although a 2 dB or 8 dB step size could be used depending on whether one wants finer or coarser test data. In other words, the actual size of the interaural level difference being measured is not important to the practice of the overall invention.

Now that one embodiment of the test set-up has been described, the underlying basis of the invention and the manner in which the set-up is used will be described.

The function of the hearing aid is to provide hearing loss compensation by providing significant gain in the high frequencies, nonetheless it is effectively a plug in the ear of the patient, thereby adversely affecting the inherent ear-brain localization ability of the patient. This invention teaches a method to improve the localization performance of the hearing aid in which the frequency dependent nature of localization cues and the frequency response of the hearing aids are used to indicate and prevent significant disruption of localization cues. The interaural localization difference data is generated by the hearing impaired listener localizing different horizontal azimuths dependent solely on the difference in intensity of the sounds present at both ears at the same time. Thus, adjustment of this interaural difference can be used to determine a differential intensity function that will achieve the same sound localization with a bilateral hearing aids as would be present in unaided ears, assuming normal hearing acuity. The differential intensity function generates a perceptually centered sound image that is used in the creation of the bilateral hearing aid fitting that is used to determine the response of the respective left and right hearing aids.

The test may be viewed as a centering test, whose principal goal is to determine the optimum interaural level difference for the hearing aid at high frequencies that will maintain the person's unaided sound localization ability. This interaural level difference data is then used in the design or the modification of both the left and right hearing aid gain functions to improve localization performance of a binaural fitting. In this centering test, the data is gathered and the results applied to the portable processor used in the hearing aid fitting in order to enhance the localization performance. In the centering test, the perceived location of the sound is varied by providing volume changes between the left and right hearing aids by using the portable processor. The interaural level difference is generated by attenuating the output at one side of the portable processor transducer module by 2 dB, 4 dB, or 8 dB, for example, and creating a shift in the perceived location of the sound source to the other side.

Although touched on relative to FIG. 2, the present inventive method and apparatus provides resultant measurements that are applied to the hearing aid fitting. While various approaches to that are possible, what is important is that the interaural level difference determined in the test is be maintained in the final hearing aid fitting. For example, if a patient has a 4 dB interaural level difference at 2 kHz, the final left and right hearing aid transfer functions will also have a 4 dB interaural level difference.

By following the technique described herein a new approach to fitting a pair of hearing aids is made possible. This technique involves determining the differences between the left and right standard hearing aid fitting and using the determined differences in the adjustment of the hearing aid fittings on a frequency dependent basis. As noted above, hearing aids are currently fitted by measuring each ear individually and then determining the compensation for that ear. This invention takes that past practice as a starting point and adjusts the individual hearing aids based on the subject's performance in a functional test that requires input from both ears to determine a specific hearing property. In the present example, it is the gain of the bilateral hearing aid that is being adjusted to improve sound localization.

The method of the present invention involving applying the measured interaural level difference data to the hearing aid, requires only that the patient or subject be fitted with hearing aids on both ears that can be adjusted. For example, the interaural level difference test can be conducted manually using the hearing aid volume controls and a notepad to record the data. The test results can be used to adjust the hearing aid fitting using standard hearing aid measurement and adjustment instrumentation. It should also be noted that the present invention does not require a digital hearing aid nor does it require that the hearing aid be programmable. All that is required is that the hearing aid have an adjustable frequency response, and almost all modern hearing aids have this feature.

Such a centering test is conducted as indicated above at the patient's most comfortable listening level for the four separate frequencies identified above. The most comfortable listening level is provided by a series of tones with the patient being asked which tone is closer to the most comfortable loudness. Thus, in order to enhance the localization performance using the test setup shown in FIGS. 2 and 3, the first step is to determine the interaural level difference as a function of frequency and at the most comfortable loudness that produces a centered sound image. This means that for each of the four frequencies being tested, certain gain values for the left and right ears are being determined. As might be appreciated, if the hearing acuity is less in the left ear than the right ear and the sound source is located at the centerline or zero in the test setup in FIGS. 2 and 3, then the apparent sound source location to that person would be shifted to the right, since the sound would be louder in the right ear than in the left ear. In order to compensate for this, the present invention teaches to determine a specific gain value at the frequency being tested to cause the apparent sound source location to be at the center line of the screen. Of course, attenuating one ear is the same as raising the gain in the other. Once this data is determined for a number of frequencies, which may include four or more frequencies, the equation and hearing loss compensation filters can be implemented.

The following steps then are performed in practicing the centering test procedure described above. The centering screen 20 and loudspeaker 22 are arranged in a test booth and the portable processor 18 connected to the fitting system or hearing aids 14 and 16. The portable processor 18 is provided with a suitable filter useful in determining interaural level differences at high frequencies and the filter values in the portable processor 18 are then controlled by the computer 32, that is, the gain is increased using the portable processor 18 at the various frequencies to achieve a target gain for the test. Typically, the hearing aids 14, 16 are adjusted to give 20 dB of gain to eliminate leakage effects. A frequency band is then selected for testing, such as, for example, from among bands with center frequencies at 2.5 kHz, 3.15 kHz, 4.0 kHz, and 5.0 kHz and then with the portable processor 18 connected to the hearing aids 14, 16 and the most comfortable loudness level is determined. As described above, one way of finding the most comfortable loudness level is to play a series of tones and ask the patient which is closer to the most comfortable loudness. At this point, the patient is instructed to face toward the zero location 24 on the screen 22 and advised that he or she will hear two bursts of noise from behind the screen. The patient is then requested to indicate which sound, the first or the second, is closer to the zero location 24 on the screen 22. By providing such a choice to the subject, it is easier for the subject to say which sound is apparently closer to the center line than if a single tone was played and the subject was instructed to identify the location of that sound. A number of different values are tested at that frequency, that is, a number of different relative level differences between the left and right hearing aids are provided at a specific frequency in order to obtain the actual value at that frequency that would cause the subject to determine that the sound is emanating from the center line of the screen. This procedure is repeated for each of the four frequencies of interest identified above.

Figure 4:
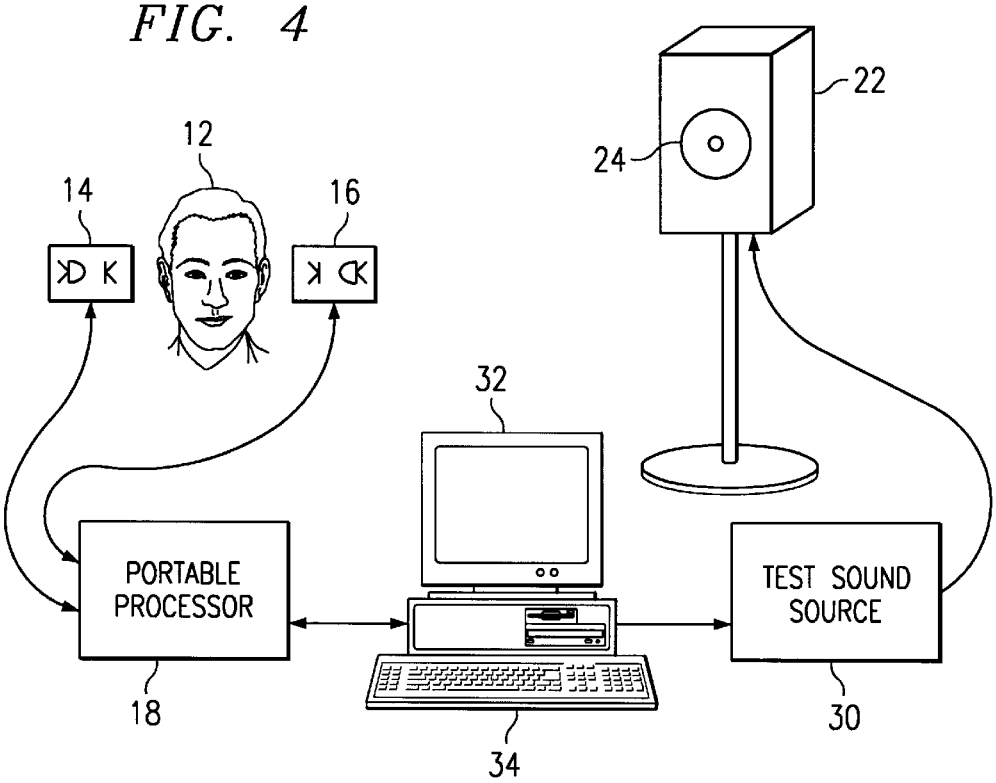
FIG. 4 is a perspective view of another embodiment of the present invention.

In the embodiment of the FIG. 4 there is no attempt to hide the location of the loudspeaker from the test subject. Thus, there is no screen required. The test subject 12 wearing the bilateral hearing aids 14, 16 is instructed to indicate, verbally or by pointing, the origin of the sounds heard based solely on the adjustments made to the hearing aids 14, 16 by the portable processor 18 and to ignore the actual location of the loudspeaker 22. Data is then collected in the same way as described above relative to the embodiment of FIG. 3, and this data is then used to design new bilateral hearing aids or to improve the localization performance by adjusting the responses of the existing hearing aids.

The test procedures described herein to measure and improve localization performance of hearing aids can be applied to improve or check localization performance of any bilateral hearing aid. Furthermore, these procedures can be utilized at any time during the hearing aid fitting process. These procedures can be used to gather data for use in designing the bilateral hearing aid prescription or used to modify existing bilateral prescriptions. Furthermore, the test data derived in these procedures can be written down manually or stored in the computer controlling the portable processor.

Although the present invention has been described hereinabove with reference to the preferred embodiment, it is to be understood that the invention is not limited to such illustrative embodiment alone, and various modifications may be contrived without departing from the spirit or essential characteristics thereof, which are to be determined solely from the appended claims.

What is claimed is:

1. Apparatus for determining an interaural level difference present in a test subject wearing a bilateral hearing aid comprising:

means for producing at least one tone centered on at least one predetermined frequency and individually audible by the test subject wearing the bilateral hearing aid;

a visual reference for use by the test subject in indicating an apparent source location of said means for producing said at least one tone;

means for establishing a differential gain value between inputs to left and right transducers in said hearing aid for said at least one tone; and means for acquiring source location data for said at least tone that is test subject derived, wherein said location data is measured with respect to said visual reference, for each said at least one tone and each said differential gain value.

2. The apparatus for determining an interaural level difference according to claim 1, further comprising:

manual input means connected to said means for establishing a differential Rain value, whereby said manual input means permits manual selection of said at least one predetermined frequency.

3. The apparatus for determining an interaural level difference according to claim 2, wherein said means for producing said at least one tone comprises an audiometer.

4. The apparatus for determining an interaural level difference according to claim 2, wherein said means for establishing a differential gain value comprises:

a computer connected to said means for producing a said at least one tone and to said keyboard for causing said means for producing said at least one tone to produce a tone having a selected frequency; and a signal processor connected to said computer and having controllable gain coefficients, whereby the respective gains of the left and right output transducers are controlled in response to said controllable gain coefficients.

5. The apparatus for determining an interaural level difference according to claim 4, wherein the sound produced by one of the left and right output transducers is louder by 4 dB than the sound produced by the other of the output transducers.

6. The apparatus for determining an interaural level difference according to claim 5, wherein said means for producing said at least one tone comprises:

a tone signal generator for producing an output signal in response to a command signal from said computer; and a loudspeaker being arranged in a sound field with the test subject for producing the audible tone in response to the output signal from said tone signal generator and wherein the visual reference is located in the sound field relative to the test subject and the loudspeaker.

7. The apparatus for determining an interaural level difference according to claim 5, wherein the gain coefficients are adjusted so that the apparent sound source location is positioned at the visual reference.

8. The apparatus for determining an interaural level difference according to claim 1, wherein said visual reference comprises a screen having locational indicia printed thereon.

9. The apparatus for determining an interaural level difference according to claim 8, wherein said screen is arranged between said means for producing said at least one tone and the test subject, and said locational indicia are printed on a side of said screen facing said test subject for indicating left and right distance increments from a vertical centerline of said screen.

10. A method for determining an interaural level difference present in a test subject wearing a bilateral hearing aid, comprising the steps of:

successively producing a plurality of tones of different respective frequencies using a loudspeaker, wherein each tone is audible to the test subject wearing the bilateral hearing aid;

providing a reference point for use by the test subject in indicating an apparent source location of said plurality of tones;

receiving signals in the bilateral hearing aid in response to the tone output in the step of producing;

controlling respective gains of the audible sounds produced in response to the signals received in the step of receiving, so that an audible sound produced by one of left and right transducers of the bilateral hearing aid is louder than a sound produced by the other of the left and right transducers; and causing the test subject to indicate an apparent location of the sound source relative to the reference point, thereby providing a measurement of the interaural level difference at a selected frequency of the tone output.

11. The method for determining an interaural level difference according to claim 10, wherein said step of controlling comprises controlling the respective gain of the audible sounds consecutively, so that said other of the left and right transducers is louder than said one of the left and right transducers and the test subject is caused to indicate the apparent location of the sound caused thereby relative to the reference point.

12. The method for determining an interaural level difference according to claim 10, further comprising determining a most comfortable sound level of the test subject by producing a series of tones of varying loudness and having the test subject select a most comfortable sound level and wherein said step of producing a tone includes producing the tone at the determined most comfortable sound level.

13. The method for determining an interaural level difference according to claim 10, further comprising the step of applying the measured interaural level difference at the selected frequency to a transfer function of the bilateral hearing aid.

14. The method for determining an interaural level difference according to claim 10, further comprising the step of repeating the steps of producing, receiving, controlling, and causing for the plurality of tones having different center frequencies.

15. The method for determining an interaural level difference according to claim 10 further comprising the step of applying the determined interaural level differences determined for all of the tested frequencies to the transfer function of the bilateral hearing aid.

16. Apparatus for determining an interaural level difference present in a test subject wearing a bilateral hearing aid, comprising:

a loudspeaker for producing at least one tone audible to the test subject;

means for producing an output signal fed to the loudspeaker for causing the loudspeaker to produce said at least one tone, centered on at least one predetermined frequency and audible by the test subject wearing the bilateral hearing aid;

a reference point for use by the test subject in indicating an apparent sound source location of said at least one tone produced by said loudspeaker;

means for establishing a differential gain value between inputs to left and right transducers in said hearing aid for said at least one tone; and means for acquiring source location data for said at least one tone that is test subject derived wherein said location data is measured with respect to said visual reference for each said tone and each said differential gain value.

17. The apparatus for determining an interaural level difference according to claim 16, further comprising:

a keyboard connected to said means for establishing a differential gain value, whereby said keyboard permits manual selection of said at least one tone.

18. The apparatus for determining an interaural level difference according to claim 17, wherein said at least one tone comprises:

a plurality of tones having center frequencies of 2.5 kHz, 3.15 kHz, 4.0 kHz and 5.0 kHz.

19. The apparatus for determining an interaural level difference according to claim 17, wherein said means for establishing a differential gain value comprises:

a computer connected to said means for producing said at least one tone and to said keyboard for causing said means for producing said at least one tone to produce a tone having a selected frequency; and a signal processor connected to said computer and having controllable gain coefficients, whereby the respective gains of the left and right output transducers are controlled in response to said controllable gain coefficients.

20. The apparatus for determining an interaural level difference according to claim 19, wherein said means for producing said at least one tone comprises:

a tone signal generator for producing said output signal, wherein said output signal is fed to said loudspeaker in response to a command signal from said computer.

21. The apparatus for determining an interaural level difference according to claim 16, wherein said reference point comprises a screen having locational indicia printed thereon.

22. The apparatus for determining an interaural level difference according to claim 21, wherein said screen is arranged between said means for producing said at least one tone and the test subject, and said locational indicia are printed on a side of said screen facing said test subject for indicating left and right distance increments from a vertical centerline of said screen.

23. A method of fitting a bilateral hearing aid to a test subject to improve a sound localization ability of the test subject, comprising the steps of:

producing at least one tone having at least one predetermined center frequency and being audible to the test subject wearing a bilateral hearing aid;

determining interaural level differences for said at least one tone; and adjusting a transfer function of the bilateral hearing aid to compensate for the determined interaural level difference for said at least one frequency, whereby an apparent sound source location perceived by the test subject corresponds to an actual sound source location.

24. The method of fitting a bilateral hearing aid according to claim 23, wherein the step of determining interaural level differences comprises the steps of:

providing a reference point for use by the test subject in indicating respective apparent source locations of said at least one tone;

receiving signals in the bilateral hearing aid in response to the tone output in the step of producing;

controlling respective gains of the audible sounds produced in response to the signals received in the step of receiving, so that an audible sound produced by one of the left and right transducers of the bilateral hearing aid is louder than a sound produced by the other of the left and right transducers; and causing the test subject to indicate an apparent location of the sound source relative to the reference point, thereby providing a measurement of the interaural level difference at a selected frequency of the tone output.

25. The apparatus for determining an interaural difference according to claim 1, wherein said at least one tone comprises:

a plurality of tones, centered respectively at a plurality of predetermined frequencies.

26. The apparatus for determining an interaural difference according to claim 16, wherein said at least one tone comprises:

a plurality of tones each centered at a predetermined frequency.

27. The method of fitting a bilateral hearing aid according to claim 23, wherein said at least one tone includes a plurality of tones having a plurality of predetermined center frequencies, the method further comprising the step of:

determining interaural level differences for each of the plurality of tones.

28. The apparatus for determining an interaural level difference according to claim 25, further comprising:

manual input means connected to said means for establishing a differential gain value, whereby said manual input means permits manual selection of each predetermined frequency.

29. The apparatus for determining an interaural level difference according to claim 28, wherein said means for producing said plurality of tones comprises:

an audiometer.

30. The apparatus for determining an interaural level difference according to claim 28, wherein said means for establishing a differential gain value comprises:

a computer connected to said means for producing said plurality of tones and to said keyboard for causing said means for producing said plurality of tones to produce a tone having a selected frequency; and a signal processor connected to said computer and having controllable gain coefficients, whereby the respective gains of the left and right output transducers are controlled in response to said controllable gain coefficients.

31. The apparatus for determining an interaural level difference according to claim 26, further comprising:

a keyboard connected to said means for establishing a differential gain value, whereby said keyboard permits manual selection of said plurality of tones.

32. The method of fitting a bilateral hearing aid according to claim 27, wherein the step of determining interaural level differences comprises the steps of:

providing a reference point for use by the test subject in indicating respective apparent source locations of said plurality of tones;

receiving signals in the bilateral hearing aid in response to the tone output in the step of producing;

controlling respective gains of the audible sounds produced in response to the signals received in the step of receiving, so that an audible sound produced by one of the left and right transducers of the bilateral hearing aid is louder than a sound produced by the other of the left and right transducers; and causing the test subject to indicate an apparent location of the sound source relative to the reference point, thereby providing a measurement of the interaural level difference at a selected frequency of the tone output.

* * * * *